US010788054B2

(12) United States Patent
Pugh et al.

(10) Patent No.: US 10,788,054 B2
(45) Date of Patent: Sep. 29, 2020

(54) REVERSE FLOW JET PUMP

(71) Applicant: Weatherford Technology Holdings, LLC, Houston, TX (US)

(72) Inventors: Toby Pugh, Fort Worth, TX (US); Osman Nunez, Fort Worth, TX (US); Michael Juenke, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 284 days.

(21) Appl. No.: 14/943,824

(22) Filed: Nov. 17, 2015

(65) Prior Publication Data

US 2016/0138616 A1 May 19, 2016

Related U.S. Application Data

(60) Provisional application No. 62/080,820, filed on Nov. 17, 2014.

(51) Int. Cl.

| | |
|---|---|
| ***F04F 5/46*** | (2006.01) |
| ***E21B 43/12*** | (2006.01) |
| ***F04F 5/10*** | (2006.01) |
| ***F04F 5/54*** | (2006.01) |

(52) U.S. Cl.

CPC ..... *F04F 5/54* (2013.01); *E21B 43/124* (2013.01); *F04F 5/10* (2013.01); *F04F 5/46* (2013.01)

(58) Field of Classification Search

CPC ..... F04F 5/04; F04F 5/10; F04F 5/46; F04F 5/463; F04F 5/54; E21B 43/124

USPC ..... 417/198

See application file for complete search history.

(56) References Cited

U.S. PATENT DOCUMENTS

| | | | | |
|---|---|---|---|---|
| 2,291,911 A * | 8/1942 | Mcmahon | E21B 43/124 417/172 |
| 4,101,246 A | 7/1978 | Erickson | |
| 4,310,288 A * | 1/1982 | Erickson | F04F 5/26 417/160 |

(Continued)

FOREIGN PATENT DOCUMENTS

GB 2254659 A 10/1992

OTHER PUBLICATIONS

International Search Report with Written Opinion dated Feb. 1, 2016 for PCT Patent Application No. PCT/US15/61098, 10 pages.

(Continued)

*Primary Examiner* — Connor J Tremarche

(74) *Attorney, Agent, or Firm* — Smith IP Services, P.C.

(57) ABSTRACT

A jet pump of a downhole tool in a wellbore, wherein the jet pump has a nozzle in fluid communication with a throat and wherein the throat is further in fluid communication with a diffuser, the jet pump further having a central channel located towards an uphole end of the downhole tool, wherein the central channel is configured to house a volume of power fluid; a first annular channel defined in the downhole tool, wherein the first annular channel is arranged around the nozzle and in fluid communication with the central channel; a volume of production fluid located towards a downhole end of the downhole tool; a second annular channel defined in the downhole tool configured to house the volume of production fluid; and a reverse channel in fluid connection with the second annular channel, wherein the reverse channel is in fluid communication with the nozzle.

15 Claims, 6 Drawing Sheets

(56) References Cited

U.S. PATENT DOCUMENTS

| | | | | | |
|---|---|---|---|---|---|
| 4,487,553 | A * | 12/1984 | Nagata | F04F 5/466 | 261/76 |
| 4,718,835 | A * | 1/1988 | Maruyama | E02F 3/90 | 137/874 |
| 5,033,545 | A * | 7/1991 | Sudol | B08B 9/035 | 134/167 C |
| 5,372,190 | A * | 12/1994 | Coleman | E21B 43/124 | 166/105 |
| 6,026,904 | A * | 2/2000 | Burd | E21B 43/14 | 166/313 |
| 2005/0061378 | A1* | 3/2005 | Foret | F04F 5/04 | 137/888 |
| 2005/0121191 | A1 | 6/2005 | Lambert et al. | | |
| 2008/0264634 | A1 | 10/2008 | Khomynets | | |
| 2010/0150742 | A1 | 6/2010 | Vetrovec | | |
| 2011/0067883 | A1 | 3/2011 | Falk et al. | | |
| 2014/0030117 | A1 | 1/2014 | Zachariah | | |
| 2015/0167697 | A1* | 6/2015 | Van Dam | F04F 5/46 | 417/54 |

OTHER PUBLICATIONS

Canadian Office Action dated Feb. 9, 2018 for CA Application No. 2,959,743, 5 pages.
Chinese Search Report dated Jun. 5, 2018 for CN Patent Application No. 201580062077.4, 8 pages.
English Translation of Chinese Search Report dated Jun. 5, 2018 for CN Patent Application No. 201580062077.4, 8 pages.
Australian Office Action dated May 2, 2018 for AU Patent Application No. 2015350138, 3 pages.
Canadian Office Action dated Aug. 27, 2018 for CA Patent Application No. 2959743, 4 pages.
Chinese Office Action dated Jan. 29, 2019 for CN Patent Application No. 201580062077.4, 3 pages.
Indoneasian Examination Report dated Aug. 19, 2019 for in Patent Application No. 201737007478, 10 pages.

* cited by examiner

REVERSE FLOW JET PUMP

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM

Not Applicable.

BACKGROUND

Technical Field

The subject matter generally relates to systems in the field of oil and gas operations wherein a jet pump having a nozzle, throat and diffuser operate through use of the Bernoulli principle.

U.S. Pat. Nos. and Publication Nos. 8,118,103; 1,604,644; 8,419,378; and 2,040,890 are incorporated herein by reference for all purposes in their respective entireties. Each and every patent, application and/or publication referenced within each respective referenced patent is also incorporated herein by reference for all purposes in its respective entirety.

BRIEF SUMMARY

A jet pump of a downhole tool in a wellbore, wherein the jet pump has a nozzle in fluid communication with a throat and wherein the throat is further in fluid communication with a diffuser, the jet pump further having a central channel located towards an uphole end of the downhole tool, wherein the central channel is configured to house a volume of power fluid; a first annular channel defined in the downhole tool, wherein the first annular channel is arranged around the nozzle and in fluid communication with the central channel; a volume of production fluid located towards a downhole end of the downhole tool; a second annular channel defined in the downhole tool configured to house the volume of production fluid; and a reverse channel in fluid connection with the second annular channel, wherein the reverse channel is in fluid communication with the nozzle.

BRIEF DESCRIPTION OF THE FIGURES

The exemplary embodiments may be better understood, and numerous objects, features, and advantages made apparent to those skilled in the art by referencing the accompanying drawings. These drawings are used to illustrate only typical exemplary embodiments of this invention, and are not to be considered limiting of its scope, for the invention may admit to other equally effective exemplary embodiments. The figures are not necessarily to scale and certain features and certain views of the figures may be shown exaggerated, in scale, or in schematic in the interest of clarity and conciseness.

DETAILED DESCRIPTION OF THE EXEMPLARY EMBODIMENT(S)

The description that follows includes exemplary apparatus, methods, techniques, and instruction sequences that embody techniques of the inventive subject matter. However, it is understood that the described exemplary embodiments may be practiced without these specific details.

Figure 1:
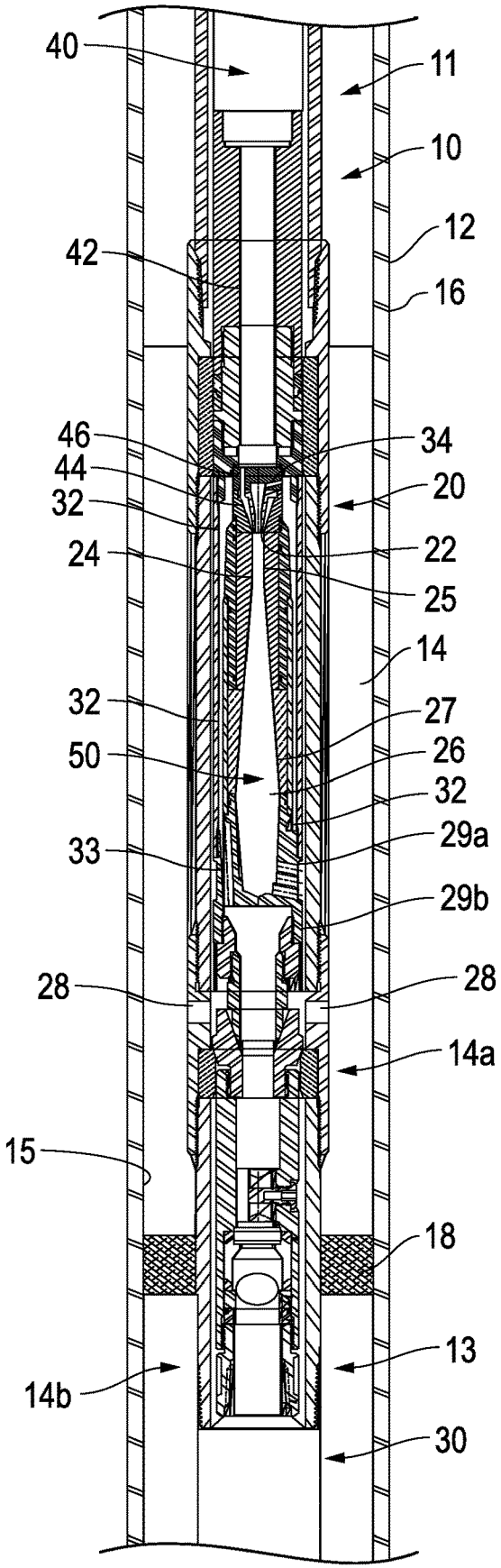
FIG. 1 depicts a schematic sectional view of an exemplary embodiment of a jet pump of a downhole tool within a wellbore.
Figure 2:
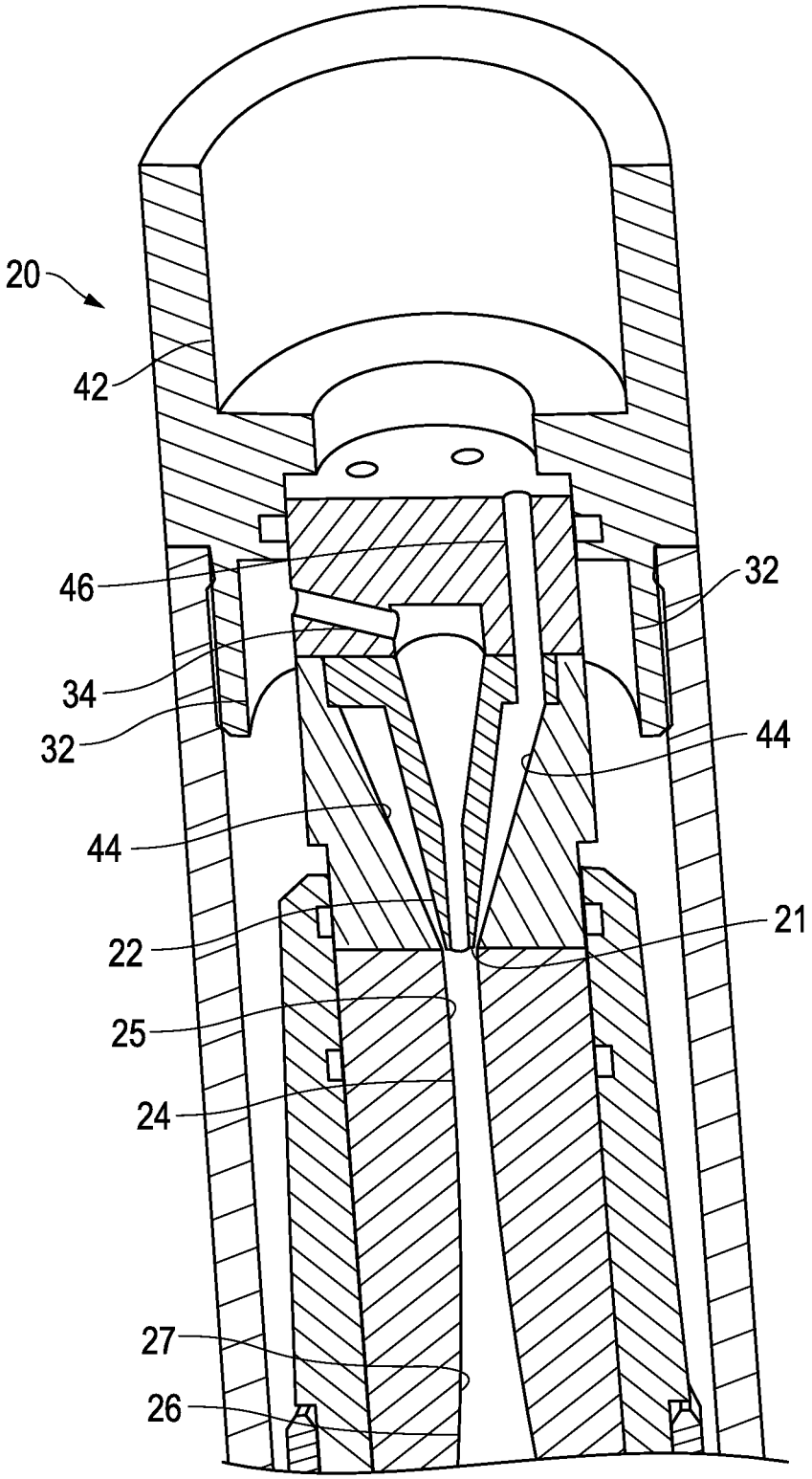
FIG. 2 depicts a perspective cross sectional view of an exemplary embodiment of a jet pump.
Figure 3:
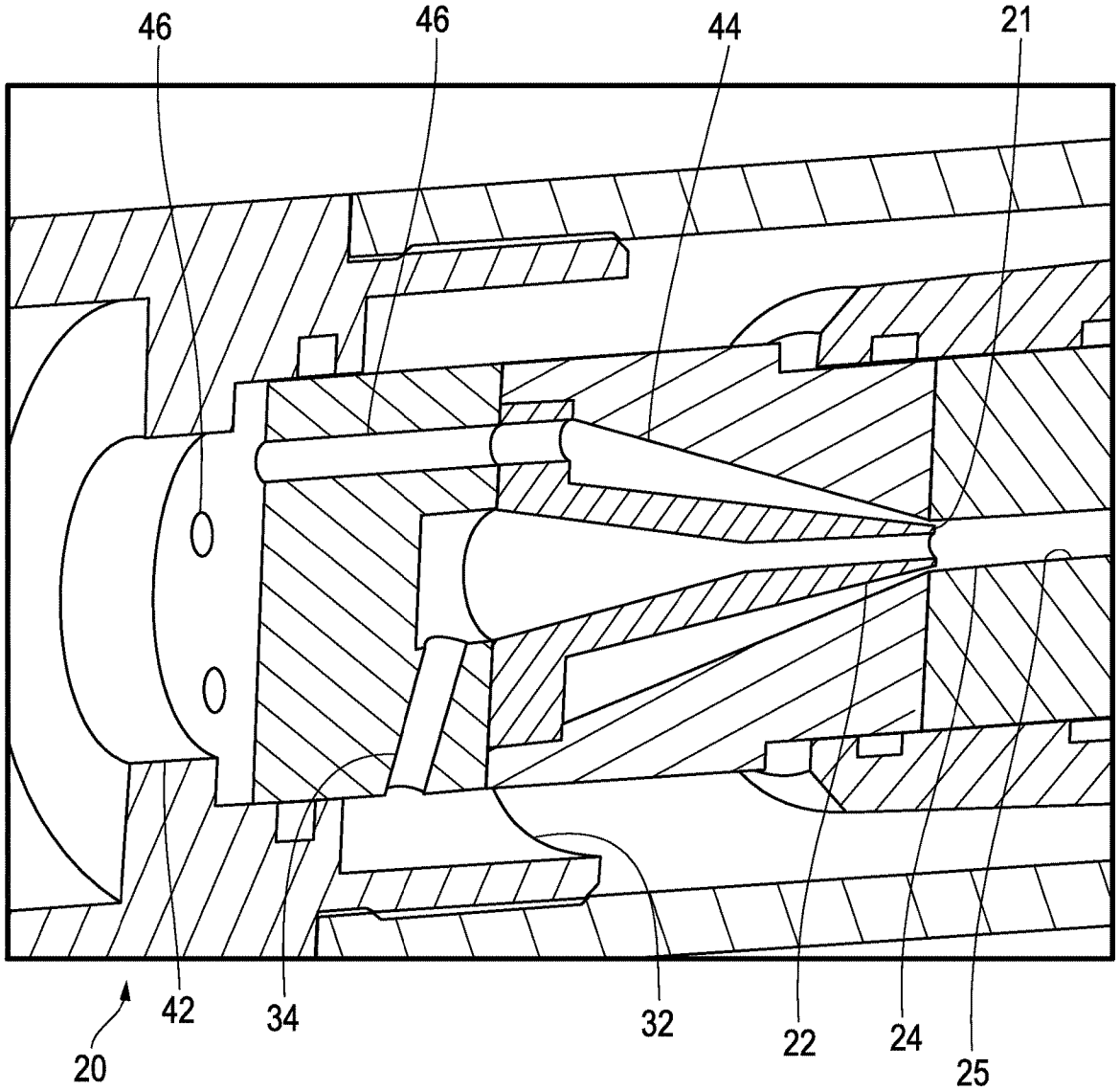
FIG. 3 depicts an enlarged view of the embodiment of FIG. 2.
Figure 4:
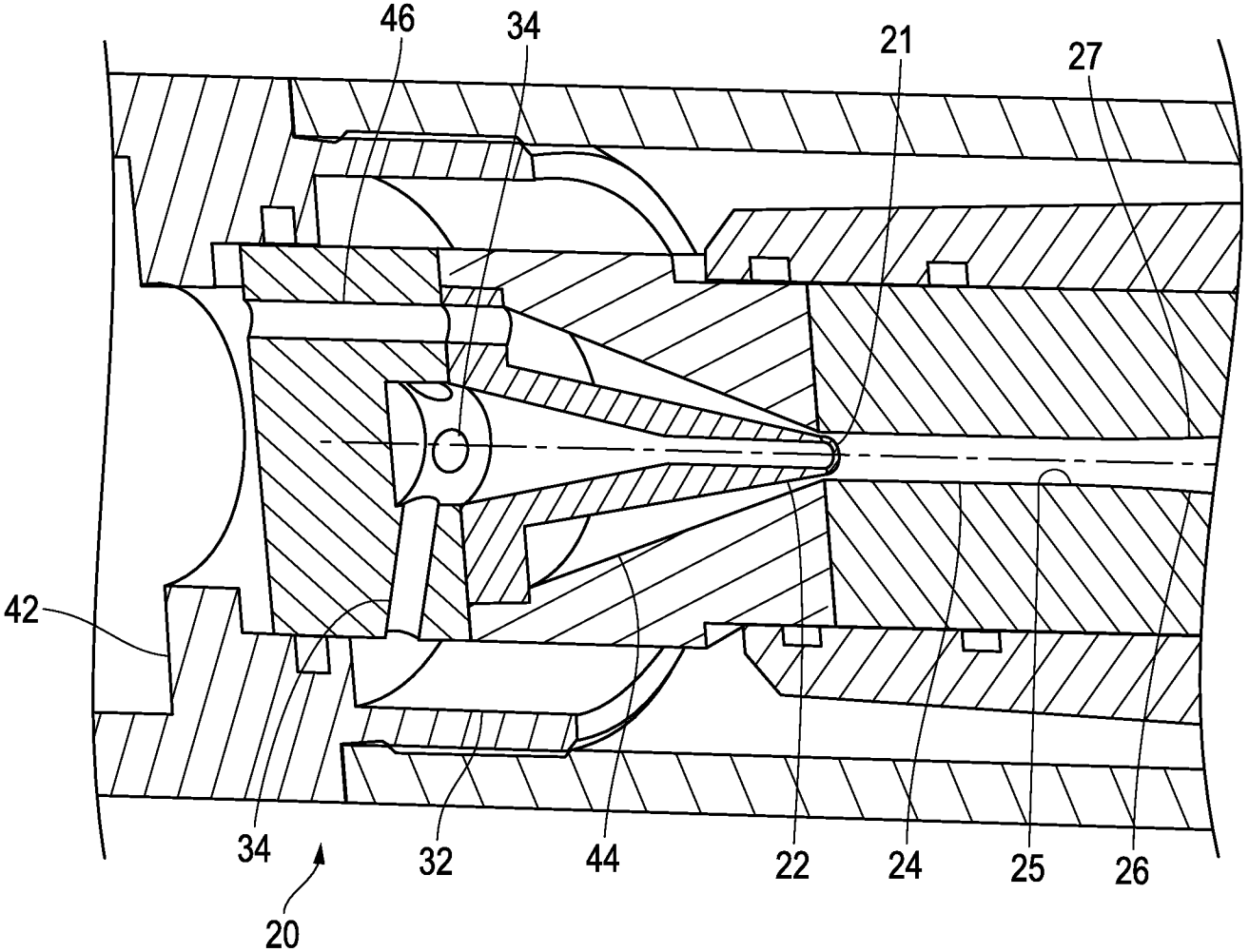
FIG. 4 depicts an alternate perspective cross sectional view of the embodiment of FIG. 2.
Figure 5:
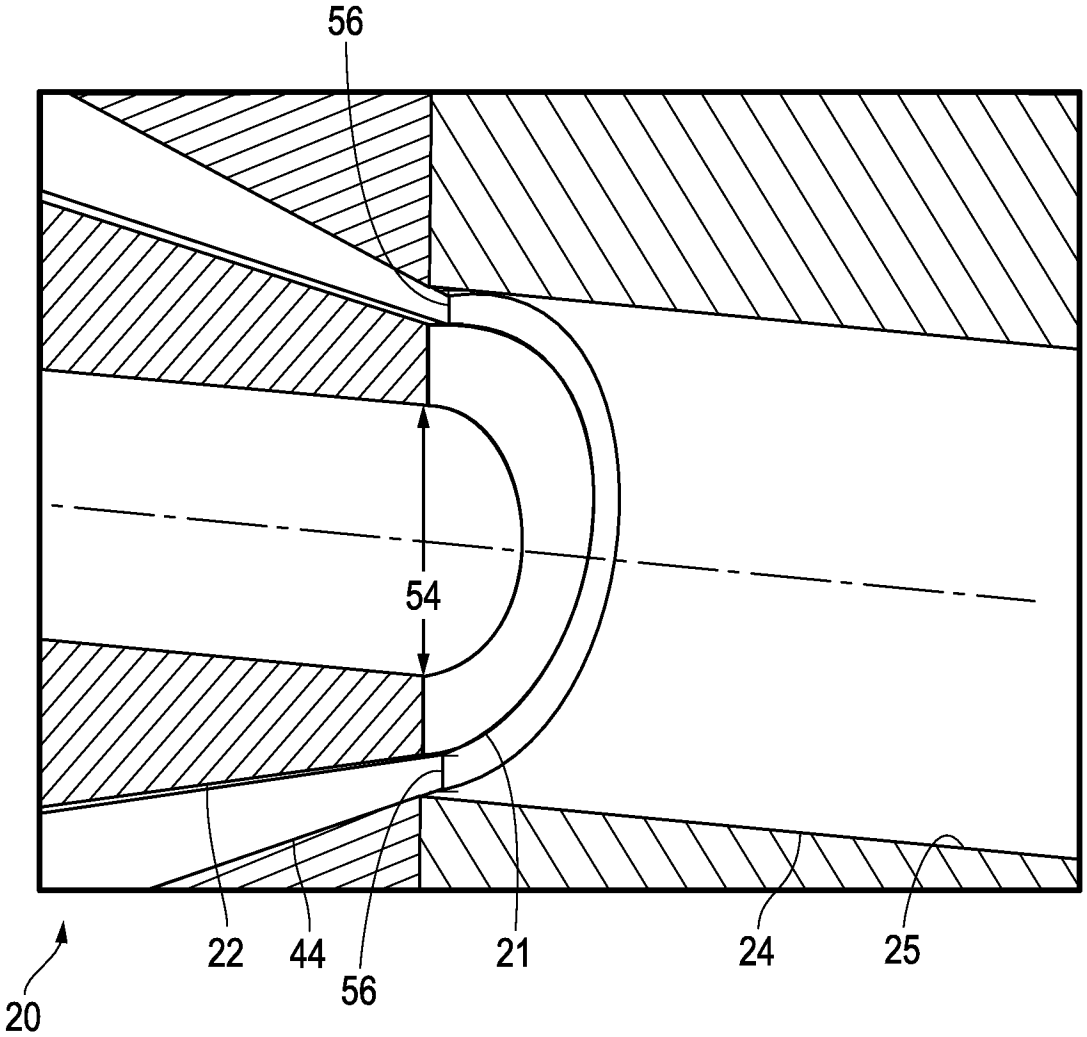
FIG. 5 depicts an enlarged view of the nozzle region of the embodiment of FIG. 4.

FIG. 1 depicts a schematic view of a downhole tool 10 in a wellbore 12 having an exemplary embodiment of a jet pump 20. As depicted in FIG. 1, the exemplary embodiment of the jet pump 20 is a liquid-liquid jet pump; optionally, the jet pump 20 may also function as a liquid-gas jet pump. The downhole tool 10 generally has an end 11 that is closer uphole to the surface of the wellbore 12 and, an end 13 that is more downhole in relation to the wellbore 12. Although the wellbore 12 is depicted as a vertical wellbore, the wellbore 12 may also have other configurations; by way of example only, the wellbore 12 may be horizontal or substantially horizontal in shape, or curved. Further, the wellbore 12 may optionally be lined with a casing or tubular 16. There may be an annulus 14 between the downhole tool 10 and the wellbore 12, or between the downhole tool 10 and casing or tubular 16. The downhole tool 10 may have a sealing element or packer 18 to sealingly engage against the inner wall 15 of the wellbore 12 or casing 16. When the oilfield operations commence, the wellbore 12 may produce a volume of production fluid 30. The downhole tool 10 may prevent the volume of production fluid 30 from entering a portion of the annulus 14 by activating the sealing element 18. The annulus 14 may further be divided into a top annulus 14*a* and bottom annulus 14*b* when the sealing element 18 is engaged.

FIGS. 2-5 depict various cross section views of an exemplary embodiment of the jet pump 20. The jet pump 20 includes a nozzle or inner nozzle 22 which is in fluid communication with a throat 24. The inner nozzle 22 may have an inner diameter of 54. Although in fluid communication with the throat 24 in the exemplary embodiments depicted in FIGS. 2-5, the tip 21 of nozzle 22 is not physically connected to the throat 24 (as seen in the enlarged cross section depicted in FIG. 5). The throat 24 is further fluidly connected to a diffuser 26 at the end opposite to the nozzle 22. The throat 24 has an inner wall or surface 25, and the diffuser 26 may also have an inner wall or surface 27. The jet pump 20 includes a central channel 42 which houses a volume of power fluid 40. The jet pump 20 may also possess one or more ports 46 which allow fluid flow from the central channel 42 to a first annularly arranged channel or annular channel or external nozzle 44 which surrounds the internal nozzle 22 (as can be seen in the enlarged view of FIG. 5). The external nozzle 44 may have a flow diameter 56 (i.e. a diametrical range between an inner and outer diameter of the annular channel/external nozzle 44 defining a gap). The flow diameter 56 of the external nozzle 44 is greater than the inner diameter 54 of the internal nozzle 22. The flow diameter 56 of external nozzle or annular channel 44 progressively narrows (or external nozzle 44 decreases in flow area) from entrance end to exit end, whilst the flow diameter 56 of the external nozzle 44 remains greater in size than the inner diameter 54 of the internal nozzle 22 from the entrance end to the exit end. Further, the first annular channel 44 may be contiguous with the inner wall 25 of the throat 24.

The jet pump 20 may also include in an exemplary embodiment a second annularly arranged or annular channel 32 which is connected to the supply or volume of production fluid 30 by production fluid duct(s) 33. In one exemplary embodiment, the diffuser 26 of the jet pump 20 may be defined within and distinct from the second annular channel 32. The second annular channel 32 may connect to a reverse channel 34, which may be a bore angled, by way of example only, at less than or equal to ninety (90) degrees in relation to the second annular channel 32, or at any other angle which may allow the flow from the reverse channel 34 into the nozzle 22 or a feed end of the nozzle 22. The reverse channel 34 is in fluid communication with the center of the nozzle 22. Further, the reverse channel 34 does not intersect the first annular channel 44 or the ports 46.

Referring back to FIG. 1, the volume of production fluid 30 and the volume of power fluid 40 may be commingled in the throat 24 and diffuser 26 to become a volume of a commingled fluid 50. Further, as can be seen in FIG. 1, in an exemplary embodiment the diffuser 26 may also have one or more outlet orifices 29*a* in fluid communication with a commingled annulus 29*b* which is in fluid communication with channel(s) 28 which guide, direct, or transport the flow of the volume of commingled fluid 50 to the top annulus 14*a*. Channel 28 in the exemplary embodiment shown is radial and generally functions to bridge or redirect flow of the commingled fluid from a downhole direction to an uphole direction. Outlet orifices 29*a* bypass or do not intersect production fluid duct(s) 33 and annular channel 32. The commingled annulus 29*b* has greater inner and outer diameters than that of the annular channel 32.

When operating the jet pump 20, the packer or sealing element 18 is activated or energized to engage with the inner wall 15 of the wellbore 12 or tubular 16, thus dividing the annulus 14 into a top portion annulus 14*a* above the packer 18 and a bottom portion annulus 14*b* below the packer 18.

The oilfield operator may then supply, provide or pump the volume of power fluid 40 into the central channel 42 of the jet pump 20. The power fluid 40 may then flow into the first annular channel 44 through ports 46, and the first annular channel 44 progressively narrows creating an annular jet of power fluid 40 flow. The power fluid 40 then moves or jets into an uphole end of the throat 24. The volume of power fluid 40 enters or jets into the throat 24 as an annular flow or stream of power fluid 40 which is adjacent to and coats or overlaps the inner wall 25 of the throat 24 providing a buffer zone between production fluid 30 and the inner wall 25.

The wellbore 12 has a supply of production fluid. 30 within the wellbore 12 and towards the bottom annulus 14*b* and downhole end 13 of the downhole tool 10. The volume of production fluid 30 may travel from the bottom annulus 14*b* of the wellbore 12 (or casing 16) into the downhole end 13 of the downhole tool 10. The volume of production fluid 30 may next flow into the production fluid duct(s) 33 and then the second annular channel 32 and through the reverse channel 34 to the nozzle 22. The production fluid 30 is entrained (via. Bernoulli principle/Venturi effect by the power fluid jetting through and out a progressively narrowing annular channel 44 into a region of greater area/volume) as a stream, or flow through the nozzle 22 and then into an uphole end of the throat 24, where the production fluid 30 flows into the middle of the annular stream of power fluid 40. The volume of power fluid 40 surrounds or buffers the production fluid 30 from contacting the inner wall 25 of the throat 24. Thus, any or many cavitation bubbles entrained in the production fluid or formed in or between the interfaces of fluids 30, 40 may implode within, or be absorbed by the volume or zone of buffering power fluid 40 and the cavitation bubbles will not contact or are buffered from contacting or harming the inner wall 25 of the throat 24, thus protecting said inner wall 25. Cavitation bubbles, if contacted with the inner wall 25 or inner wall 27, may erode and damage the throat 24 and/or diffuser 26, respectively. The power fluid 40 and production fluid 30 may also initiate comingling at an interface between the respective fluids, whilst buffering of the production fluid 30 by the power fluid 40, in the throat 24 of the jet pump 20 and may then flow together further comingling in the diffuser 26.

Although the power fluid 40 and production fluid 30 may begin comingling in the throat 24 to form a volume of commingled fluid 50, a distinct layer or buffer of power fluid 40 may still persist in at least a portion of or overlapping the inner wall 27 of the diffuser 26, such that the diffuser 26 may also be protected from cavitation bubbles with a buffer of power fluid 40. The volume of production fluid 30 and volume of power fluid 40 may continue to commingle in the diffuser. Thereafter, the volume of commingled fluid 50 may leave the diffuser 26 through one or more outlet orifices 29*a* (to bypass production fluid duct(s) 33) flowing next to commingled annulus 29*b* and then to channel(s) 28 for exiting the diffuser 26. These outlet orifices 29*a*, commingled annulus 29*b* and channel(s) 28 allow fluid communication from the diffuser 26 to the annulus 14 (or upper annulus 14*a*) whilst redirecting flow from the downhole direction as after leaving the channel(s) 28, the commingled fluid 50 travels, moves or is transported uphole in the annulus 14*a* to the surface of the wellbore 12 where the commingled fluid 50 can be retrieved by the oilfield operator.

Figure 6:
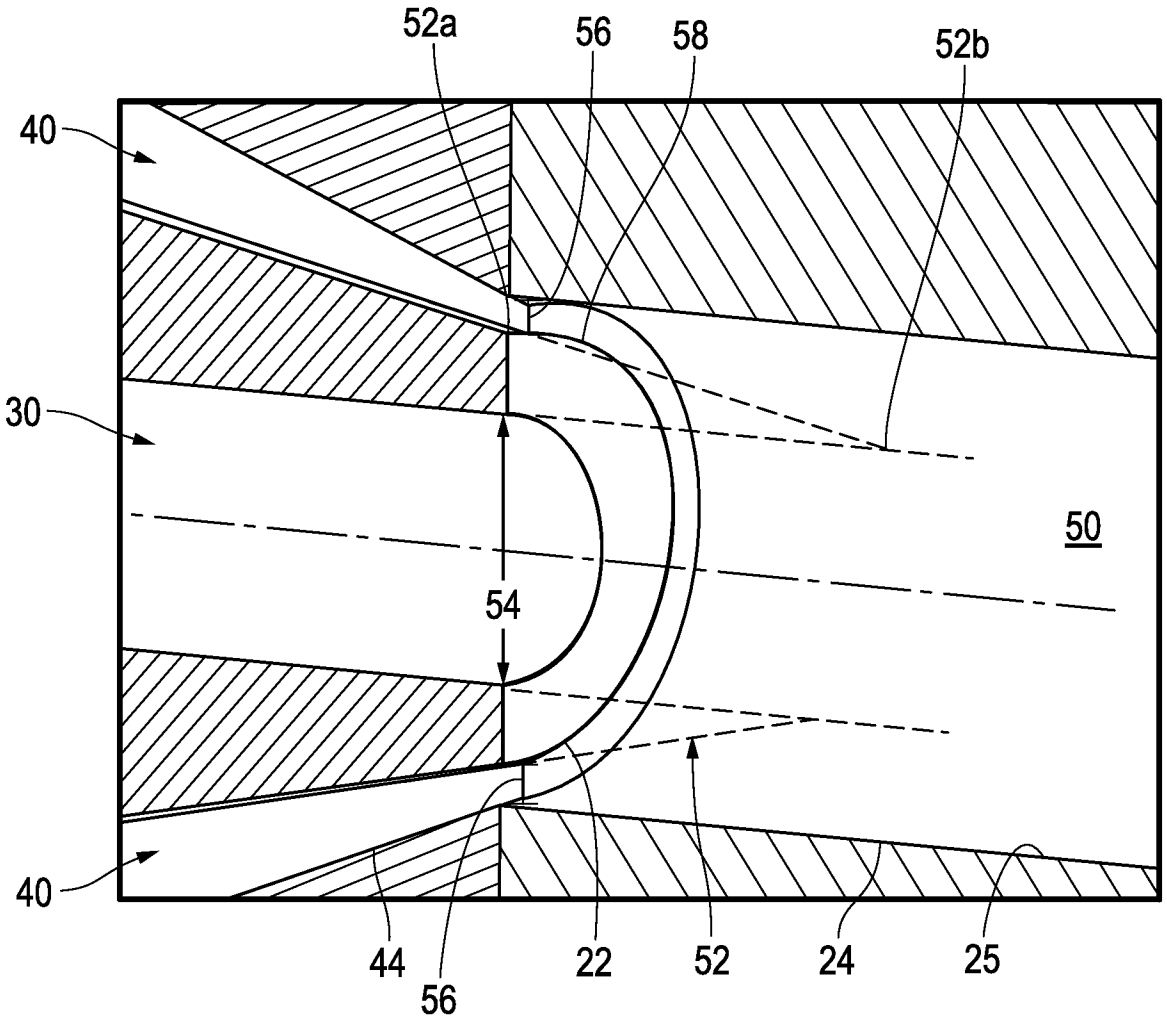
FIG. 6 depicts a schematic sectional view in perspective of the volume of production fluid and the volume of power fluid in the nozzle and throat region.

FIG. 6 depicts a schematic view of the volume of production fluid 30 and the volume or buffer of power fluid 40 in contact in the nozzle 22, 44 and throat 24 region. The surface area(s) or region(s) of contact 52 (defined generally as a cylindrical and/or frusto-conical shaped surface area or region) respectively between the two fluids 30, 40 as depicted in FIG. 6 may have different geometries in alternative exemplary embodiments. For example, the surface area(s) of contact 52 may extend much farther into the throat 24 in alternative exemplary embodiments than is depicted in FIG. 6, or the two fluids 30, 40 may contact immediately after leaving the tip 21 of the nozzle 22. It is to be appreciated that even if portions of the fluids 30, 40 begin to mix into a volume of commingled fluid 50 in the throat 24, that a residual buffer of power fluid 40 may persist well into the throat 25 or diffuser 26 by laying adjacent to the inner walls 25, 27 (see FIG. 4), respectively.

By way of example only, the surface areas of contact 52 may further be characterized as an initial surface area of contact 52*a* and a variable surface area of contact 52*b*. The initial surface area of contact 52*a* between the two volumes fluids 30, 40 may occur at or proximate an inner wall 58 of the flow diameter 56 of the external nozzle 44 (at a first position where the volume of production fluid 30 exits the tip 21 of the internal nozzle 22, at an inner diameter 54 of the internal nozzle 22). The variable surface area of contact

52*b* between the two volumes of fluids 30, 40 is a second downstream position 52*b* (relative to the first position 52*a*) which may occur at some variable distance within the throat 24 or diffuser 26. The resultant surface area(s) of contact 52 between the jetted volume of power fluid 40 after exiting the exterior annular passage (or the external nozzle) 44 (especially if at, proximate or nearer the first position/initial surface area of contact 52*a*) and the volume of production fluid stream 30, is relatively larger or greater than the surface area of contact between the two fluids in conventional prior art jet pumps (where the jet core is in the center and production fluid flows around of the jet core).

Advantage(s) resulting from the foregoing is that since the surface area of contact 52 between the volumes of power fluid 40 and produced/production fluid 30 is considerably or relatively larger in the present jet pump 20, the momentum transfer between the two volumetric streams of fluids 30, 40 can be more effective than in conventional prior art jet pump configurations (which may only have an efficiency on the order of 30-35%), and increasing the surface area of contact 52 (i.e. increasing the surface area that the volume of power fluid 40 and the volume of produced fluid 30 are in contact directly relates to increasing the efficiency in jet pump 20).

While the exemplary embodiments are described with reference to various implementations and exploitations, it will be understood that these exemplary embodiments are illustrative and that the scope of the inventive subject matter is not limited to them. Many variations, modifications, additions and improvements are possible. For example, although the exemplary embodiments have been depicted and described with various "annular" channels (for example, annular channels 32, 44 and 29*b*), it is to be appreciated that these channels may not necessarily be annular in shape, but may be of any orientation to allow and arrange for the flow of the production fluid and power fluid as described. As an additional example, although central channel 42 is depicted and described as a central axial throughbore of the downhole tool 10, it is to be appreciated that the supply of the volume of power fluid 40 may reach the annular channel 44 through other flow path geometries.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. A downhole tool, comprising:

an internal nozzle;

an annular nozzle surrounding the internal nozzle;

a central channel located at an uphole end of the downhole tool, wherein the central channel is configured to receive a pressurized power fluid;

a port which fluidly connects the central channel and the annular nozzle, wherein the power fluid flows from the central channel to the annular nozzle via the port;

an annular channel surrounding the annular nozzle, wherein the annular channel is configured to receive a production fluid from a downhole end of the downhole tool; and a reverse channel which fluidly connects the annular channel and the internal nozzle, wherein the production fluid flows from the annular channel to the internal nozzle via the reverse channel.

2. The apparatus of claim 1, further comprising:

a throat, wherein the throat receives the power fluid as the power fluid exits the annular nozzle, and wherein the throat receives the production fluid as the production fluid exits the internal nozzle;

a diffuser extending from the throat; and a fluid bypass at an end of the diffuser opposite of the throat, wherein the power fluid and the production fluid exit the downhole tool via the fluid bypass.

3. The apparatus of claim 1, wherein the reverse channel is a bore angled at less than or equal to 90 degrees in relation to the annular channel.

4. The apparatus of claim 1, wherein the reverse channel does not intersect the annular nozzle.

5. The apparatus of claim 1, wherein the power fluid exits the annular nozzle adjacent to an inner wall of the throat and surrounds the production fluid as the production fluid exits the internal nozzle.

6. The apparatus of claim 1, wherein the annular nozzle progressively decreases in flow area from an entrance end to an exit end.

7. A method of pumping a production fluid from a wellbore via a downhole tool, the method comprising:

receiving a pressurized power fluid at a central channel located at an uphole end of the downhole tool;

flowing the power fluid from the central channel into an annular nozzle via a port, wherein the annular nozzle surrounds an internal nozzle;

jetting the power fluid out of the annular nozzle into a throat of the downhole tool;

drawing production fluid from a downhole end of the downhole tool into an annular channel surrounding the annular nozzle;

flowing the production fluid from the annular channel into the internal nozzle via a reverse channel; and flowing the production fluid out of the internal nozzle into the throat of the downhole tool.

8. The method of claim 7, further comprising creating a buffer along an inner wall of the throat with the power fluid.

9. The method of claim 8, further comprising imploding an amount of cavitation bubbles in the power fluid.

10. The method of claim 9, further comprising commingling the production fluid and the power fluid to form a commingled fluid; and flowing the commingled fluid out of the downhole tool via a fluid bypass.

11. The method of claim 10, further comprising redirecting flow of the commingled fluid from a downhole direction to an uphole direction.

12. The method of claim 7, wherein the jetting the power fluid further comprises increasing a momentum transfer between the power fluid and the production fluid.

13. The method of claim 12, wherein said increasing the momentum transfer comprises jetting the power fluid at a flow diameter of the annular nozzle, wherein the flow diameter of the annular nozzle is greater than an inner diameter of the internal nozzle.

14. The method of claim 8, wherein the step of creating the buffer along the inner wall of the throat with the power fluid comprises creating a variable surface area of contact between the power fluid and the production fluid, and wherein an external surface area of the production fluid is equivalent to an inner surface area of the power fluid.

15. The method of claim 10, further comprising setting a packer of the downhole tool, thereby dividing an annulus formed between the downhole tool and the wellbore into a top annulus portion and a bottom annulus portion; and flowing the commingled fluid into the top annulus portion via the fluid bypass.

* * * * *